US007280080B2

(12) United States Patent
Baird et al.

(10) Patent No.: US 7,280,080 B2
(45) Date of Patent: Oct. 9, 2007

(54) MULTIPLE BEAM FEED ASSEMBLY

(75) Inventors: Andrew Baird, Bramley (GB); Neil Wolfenden, Bracknell (GB)

(73) Assignee: Andrew Corporation, Westchester, IL (US)

( * ) Notice: Subject to any disclaimer, the term of this patent is extended or adjusted under 35 U.S.C. 154(b) by 216 days.

(21) Appl. No.: 10/906,273

(22) Filed: Feb. 11, 2005

(65) Prior Publication Data

US 2006/0181472 A1 Aug. 17, 2006

(51) Int. Cl.
*H01Q 13/20* (2006.01)
*H01P 1/161* (2006.01)

(52) U.S. Cl. ..... 343/776; 333/137; 333/21 A

(58) Field of Classification Search ..... 333/125, 333/137, 21 A; 343/776
See application file for complete search history.

(56) References Cited

U.S. PATENT DOCUMENTS

| | | | | |
|---|---|---|---|---|
| 4,342,036 | A | 7/1982 | Scott et al. | |
| 4,516,089 | A * | 5/1985 | Goscianski et al. | 333/135 |
| 4,639,731 | A | 1/1987 | Karlsson et al. | |
| 5,381,596 | A | 1/1995 | Ferro | |
| 5,576,721 | A | 11/1996 | Hwang et al. | |
| 5,581,217 | A | 12/1996 | Macdonald | |
| 5,629,654 | A | 5/1997 | Frick | |
| 5,929,728 | A | 7/1999 | Barnett et al. | |
| 6,166,704 | A | 12/2000 | Jan et al. | |
| 6,426,729 | B2 * | 7/2002 | Yoshida et al. | 343/786 |
| 6,573,803 | B1 | 6/2003 | Ziegner et al. | |
| 6,664,933 | B2 | 12/2003 | Spirtus | |
| 6,714,166 | B2 * | 3/2004 | Sasaki et al. | 343/785 |
| 6,727,779 | B2 * | 4/2004 | Yuanzhu et al. | 333/125 |
| 2002/0005806 | A1 | 1/2002 | Adrian et al. | |
| 2002/0097187 | A1 | 5/2006 | Hiroaki et al. | |

FOREIGN PATENT DOCUMENTS

| | | |
|---|---|---|
| EP | 1050925 | 11/2000 |

* cited by examiner

*Primary Examiner*—Benny T. Lee
(74) *Attorney, Agent, or Firm*—Babcock IP, PLLC

(57) ABSTRACT

A multi-beam feed assembly having a feed assembly housing with a plurality of input waveguide(s) formed in a front face. The housing may be adapted for manufacture via die casting. The housing also having at least two PCB mounting surface(s), a plurality of probe aperture(s) through the housing between the input waveguide(s) and at least one of the PCB mounting surface(s) and at least one interconnect waveguide through the housing between two of the PCB mounting surface(s). A plurality of PCB may be coupled to the housing at the PCB mounting surfaces. A plurality of transition probe(s) located in the probe aperture(s) coupling each input waveguide to one of the plurality of the PCB and the at least one interconnect waveguide between the at least two PCB mounting surfaces coupling signals between the PCB.

20 Claims, 8 Drawing Sheets

10

MULTIPLE BEAM FEED ASSEMBLY

BACKGROUND

The reflector of a microwave reflector antenna is adapted to concentrate a reflected beam from a distant source such as a satellite upon a feed assembly positioned proximate a focal area of the reflector. In satellite communications systems such as consumer broadcast satellite television and or internet communications, a single reflector antenna having multiple feeds may receive signal(s) from multiple satellites arrayed in equatorial orbit. A central feed is arranged on a beam path from a center satellite to the reflector and from the reflector to the feed. Subsequent feeds for additional satellite beam paths use the same reflector but are arranged at an angle to either side of the central feed beam path. Alternatively, two feeds may be equally offset from the center position.

To minimize interference between closely spaced beams, adjacent satellites may be configured to use different operating frequency bands, such as the Ka and Ku frequency bands. Therefore, each antenna feed assembly is optimized for the corresponding frequency band. Each feed typically incorporates a low noise amplifier (LNA) circuit positioned proximate the feed input to amplify initially weak received signals before further degradation and or signal loss occurs. Signals from the multiple feed outputs may be mixed to a lower intermediate frequency and combined together via diplexer and switch circuitry proximate the feeds to allow multiple feed signals to be combined for transmission to downstream equipment on a common transmission line.

Multiple satellite spacing for consumer satellite communications systems previously required a larger degree angle of beam separation which could be implemented by arraying multiple individual beam path feed assemblies spaced away from each other, for example at a distance of 60 mm. Increasing demand for additional consumer satellite capacity/content has created a need for reception capability of satellites spaced closer together in orbit, for example requiring beams with a 1.8 degree angle of separation. For a similar sized reflector, this beam spacing requires a smaller 18 mm feed spacing. Prior cost effective individual feed assemblies are typically too large to allow an adjacent feed assembly spacing of 18 mm. Larger reflectors may be applied to increase the required feed spacing but an increased reflector size is commercially undesirable.

Prior high density multiple feed RF assemblies have used separate feed waveguide castings to increase the physical separation between the LNA inputs. Alternatively, if the feed spacing is sufficiently large, the waveguide to microstrip launch for each feed is contained on a single PCB. In this case, a separate waveguide "manifold" casting may be applied. The additional components and associated waveguide junctions add cost, manufacturing variables and or introduce potential failure points to the resulting assembly.

The increasing competition for mass market consumer reflector antennas has focused attention on cost reductions resulting from increased materials, manufacturing and service efficiencies. Further, reductions in required assembly operations and the total number of discrete parts are desired.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with the general and detailed descriptions of the invention appearing herein, serve to explain the principles of the invention.

DETAILED DESCRIPTION

Figure 1:
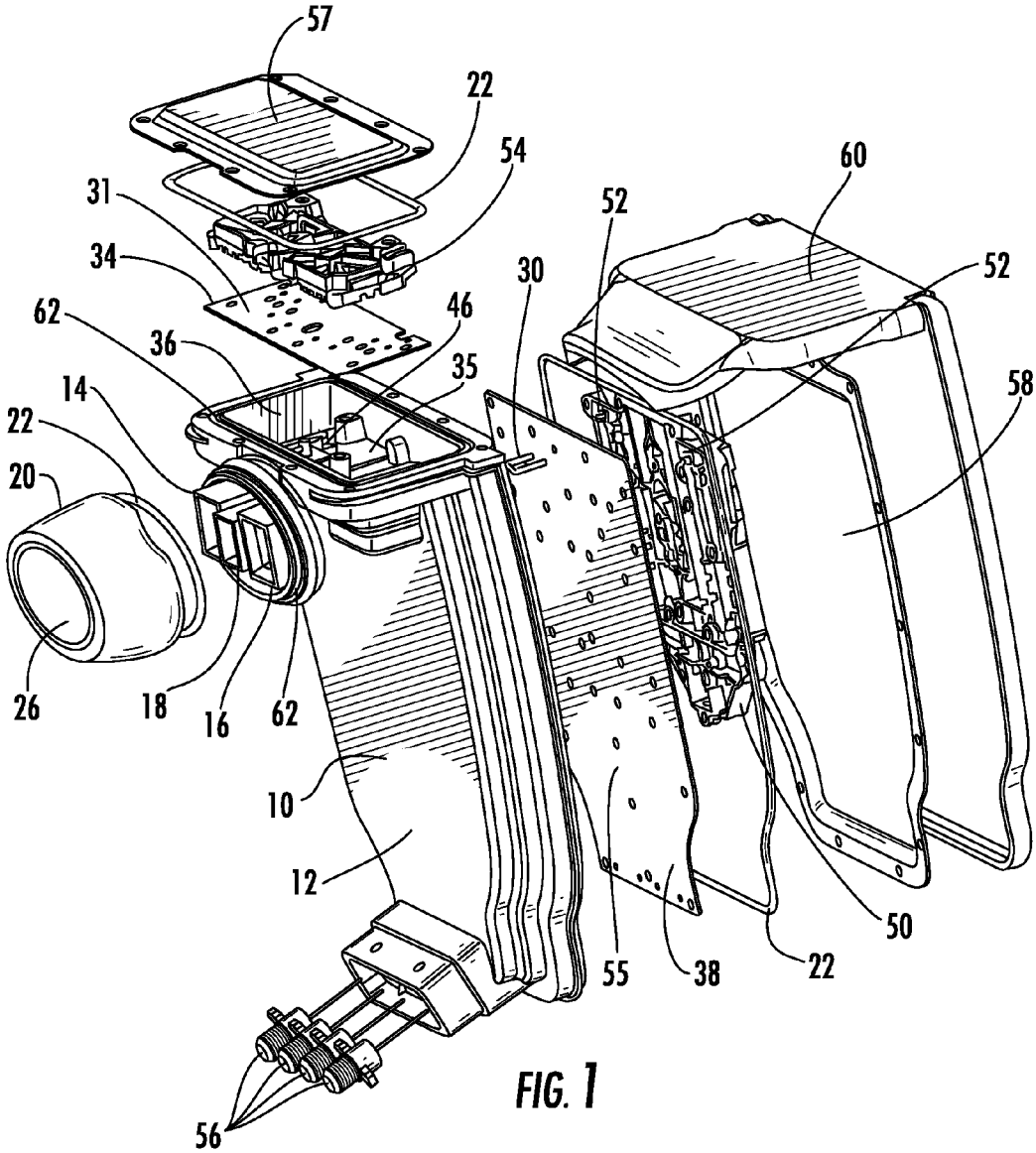
FIG. 1 is a schematic exploded isometric view of a feed assembly according to an exemplary embodiment of the invention.

Adjacent input waveguides formed in a common main housing having printed circuit boards (PCB) oriented at an angle to each other provide the present invention with a compact overall size and improved signal characteristics for use with multiple closely angled signal beams. An exemplary embodiment of a multiple beam feed assembly according to the invention is shown in FIG. 1. One skilled in the art will appreciate that the exemplary embodiment may be readily adapted into alternative configurations. For example, the number of input waveguides, their orientation and operating frequencies may be adapted as desired.

Figure 2:
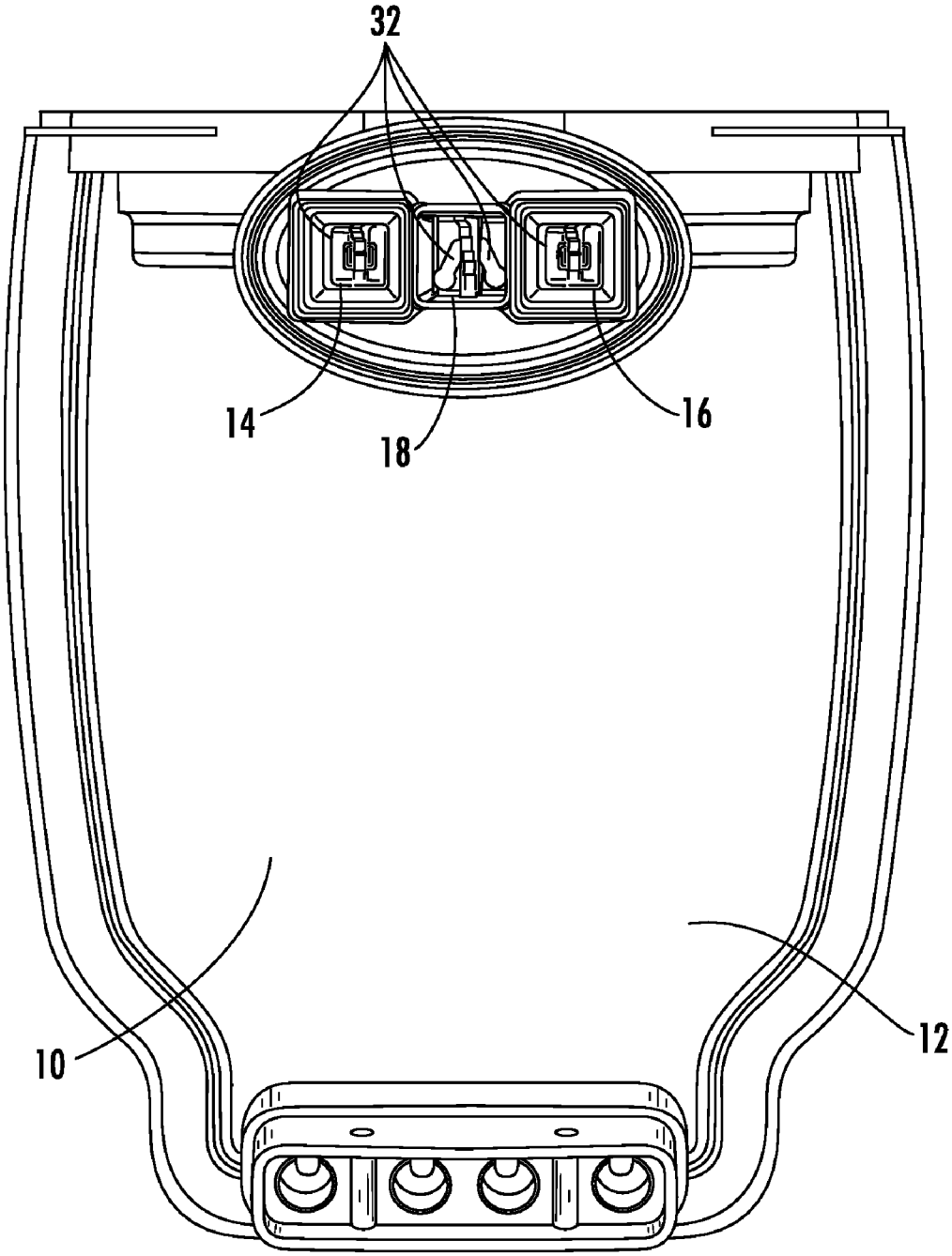
FIG. 2 is a front side isometric view of the main housing shown in FIG. 1.

A main housing 10 houses and or supports the various components of the feed assembly. As shown in greater detail in FIGS. 2-4, the main housing 10 has three input waveguides formed in a front face 12. One skilled in the art will appreciate that the three input waveguides are each dimensioned for a desired frequency band. Here, Ka first and second input waveguides 14, 16 are positioned on either side of a central Ku third input waveguide 18. The Ka first and second input waveguides 14, 16 may be oriented with respect to the center Ku third input waveguide 18 to align them with a desired beam separation angle of, for example, 1.8 degrees. Alternatively, the input waveguide(s) 14, 16, 18 may be formed parallel to each other with a waveguide aperture 24 positioned at a distance from the reflector antenna main reflector selected to align the desired input waveguide 14, 16 or 18 with a desired beam. Thereby each of the input waveguides may be adapted for reception of a separate satellite beam from different equatorial orbit satellites positioned, for example, 1.8 degrees from each other.

The first, second and third input waveguides 14, 16, 18 may be environmentally sealed by a common radome 20 adapted to snap fit upon the main housing 10, as shown in FIG. 1. A sealing gasket 22, such as an o-ring, may be used to further improve the environmental seal. Because both Ka and Ku bands are being received, the waveguide aperture(s) 24 of the respective first, second and third input waveguide(s) 14, 16, 18 are preferably positioned at a distance from the radome 20 forward surface 26 that is a multiple of the respective center frequency wavelength to minimize undesired signal reflections from the radome 20 forward surface 26.

Figure 3:
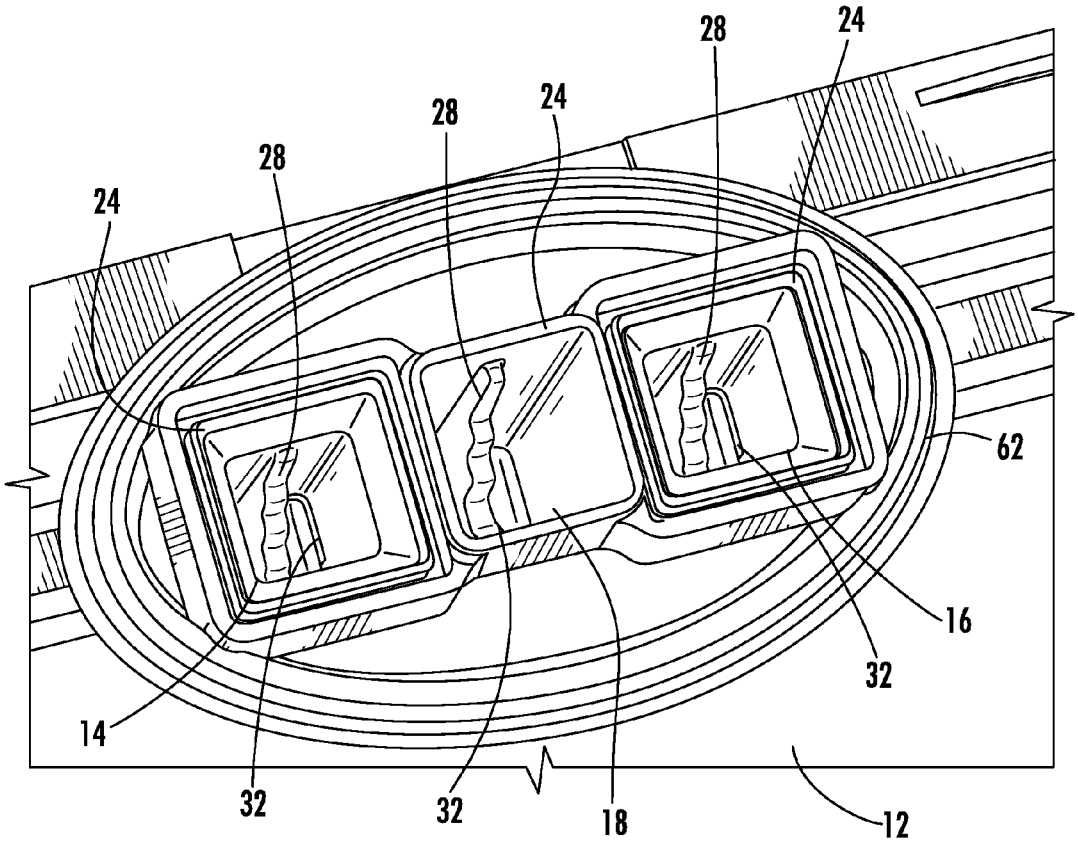
FIG. 3 is a close-up front side isometric view of the input waveguide area of the main housing shown in FIG. 2.
Figure 4:
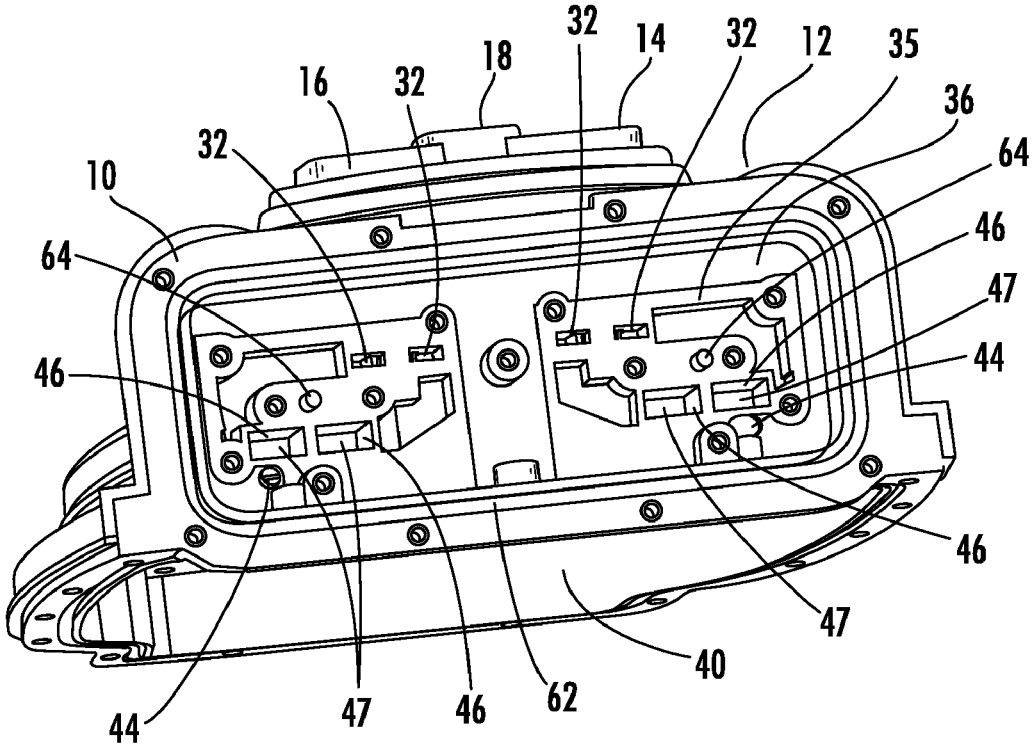
FIG. 4 is a top side isometric view of the main housing shown in FIG. 1.

As shown in FIG. 3, a septum polarizer 28 within each of the first, second and third input waveguide(s) 14, 16, 18 separates circularly polarized input signals into separate linear polarizations for transition probe(s) 30 dedicated to each polarization. The transition probe(s) 30 are inserted through probe aperture(s) 32 of the first, second and third input waveguide(s) 14, 16, 18.

Figure 5:
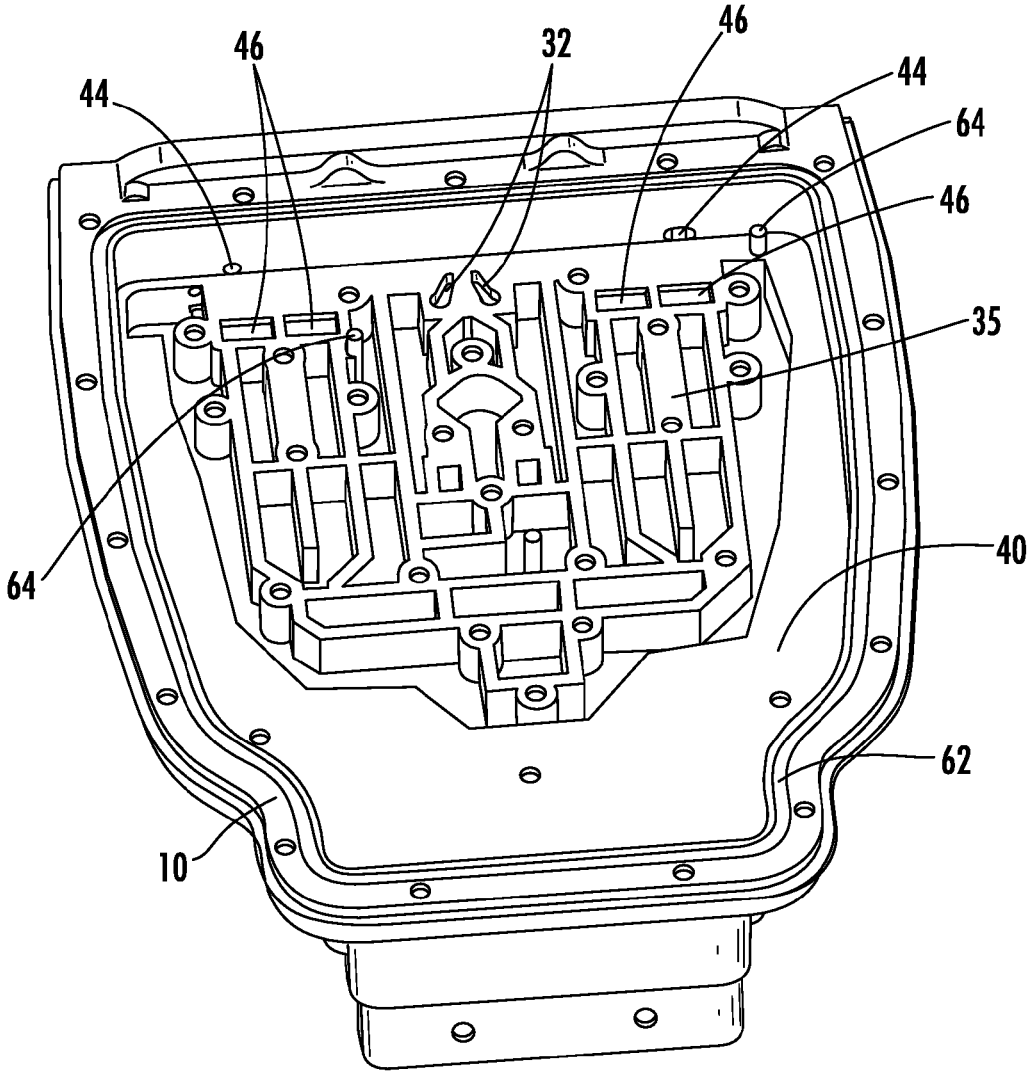
FIG. 5 is a back side isometric view of the main housing shown in FIG. 1.
Figure 6:
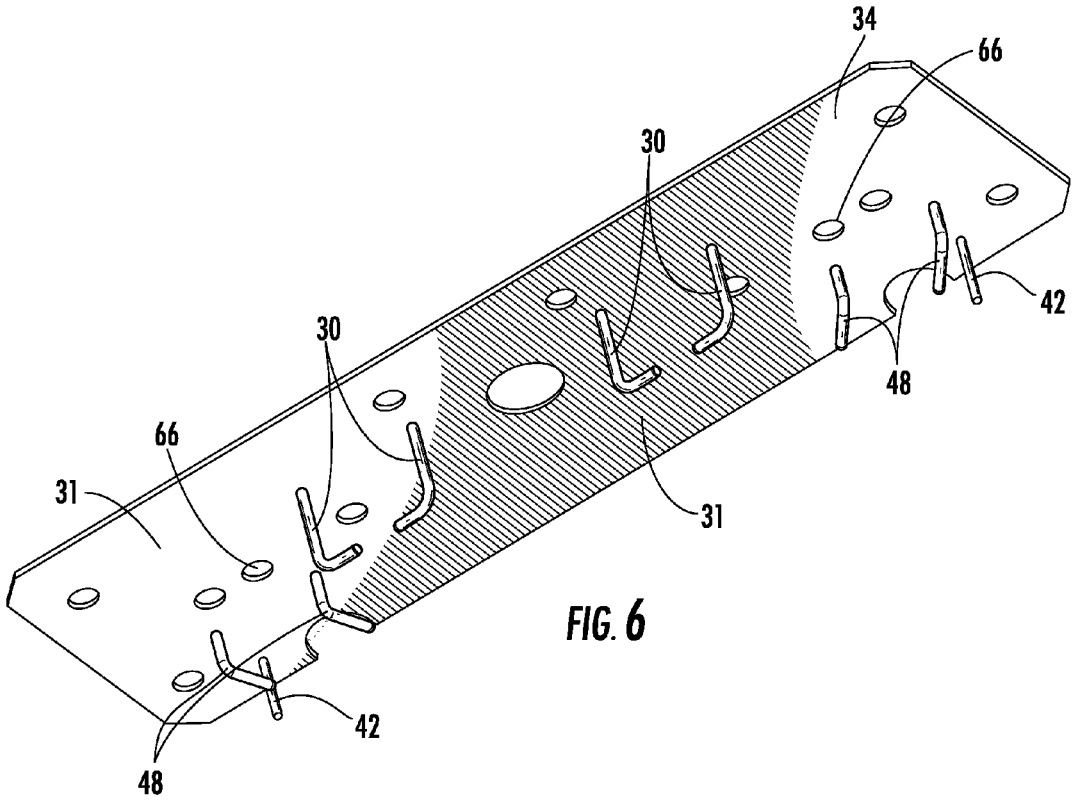
FIG. 6 is a bottom side isometric view of the top PCB shown in FIG. 1.

To enable each of the six transition probe(s) 30 to each terminate proximate a dedicated LNA circuit 31, the first and second input waveguide 14, 16 transition probe(s) 30 are terminated onto a top printed circuit board (PCB) 34, as shown in FIG. 6, nested onto a PCB mounting surface 35 within a top PCB cavity 36 (FIG. 4 ) of the main housing 10 located above the first, second and third input waveguide(s) 14, 16, 18. The third input waveguide 18 transition probe(s) 30 terminate on a back PCB 38 nested onto another PCB mounting surface 35 within a back PCB cavity 40 (FIG. 5) of the main housing 10.

The top PCB 34 LNA circuit(s) 31 may be energized by power lead(s) 42 coupled between the top PCB 34 and the back PCB 38 that pass through power lead aperture(s) 44 formed in the main housing 10 between the top cavity 36 and the back cavity 40. Signals from the first and second input waveguides 14, 16, each amplified by the LNA circuit(s) 31 of the top PCB board 34 are each coupled to the back PCB 38 for further processing by interconnect waveguide(s) 46 formed in the main housing 10. Interconnect waveguide probe(s) 48 mounted to the top PCB 34 are positioned to insert within the interconnect waveguide(s) 46 to launch signals from the top PCB board 34 into the interconnect waveguide(s) 46.

The interconnect waveguide(s) 46 compensate for the tangential orientation of the present embodiment (a planar angle of 90 degrees) between the top PCB 34 and the back PCB 38 mounting point(s) 35 via a 90 degree interconnect waveguide bend 47 formed in each interconnect waveguide 46. In alternative embodiments, the planar angle between the various PCBs may be arranged at a desired angle adapted to allow space efficient distribution of the transition probes between the PCBs, for example greater than 30 degrees, and the necessary interconnect waveguide bend 47 angle applied. A probe PCB trace or other form of interconnect waveguide probe 48 (not shown) positioned within a waveguide aperture of the back PCB 38, may be used to couple the signals in each interconnect waveguide 46 to the back PCB 38 circuitry.

Figure 7:
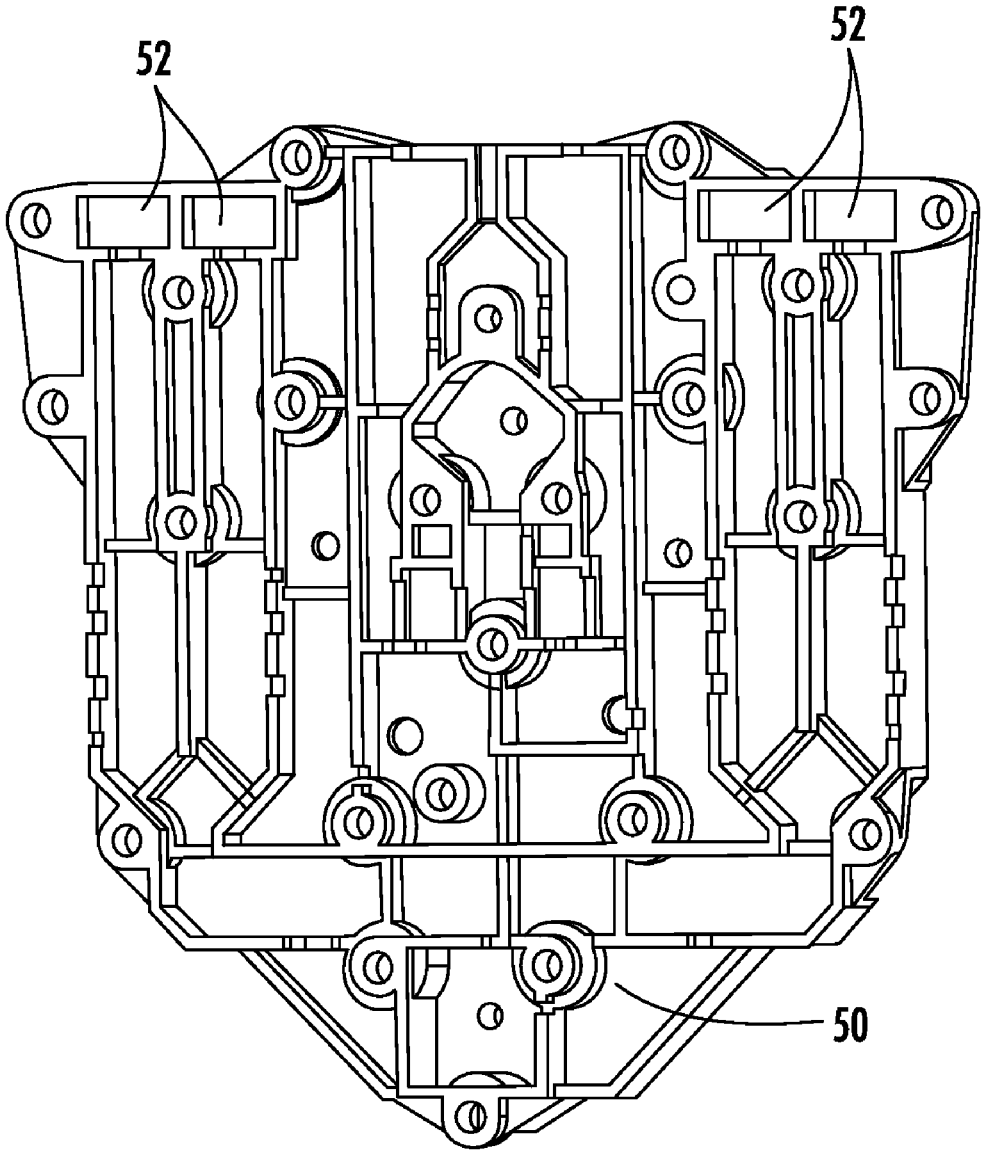
FIG. 7 is a front side isometric view of the back shield shown in FIG. 1.
Figure 8:
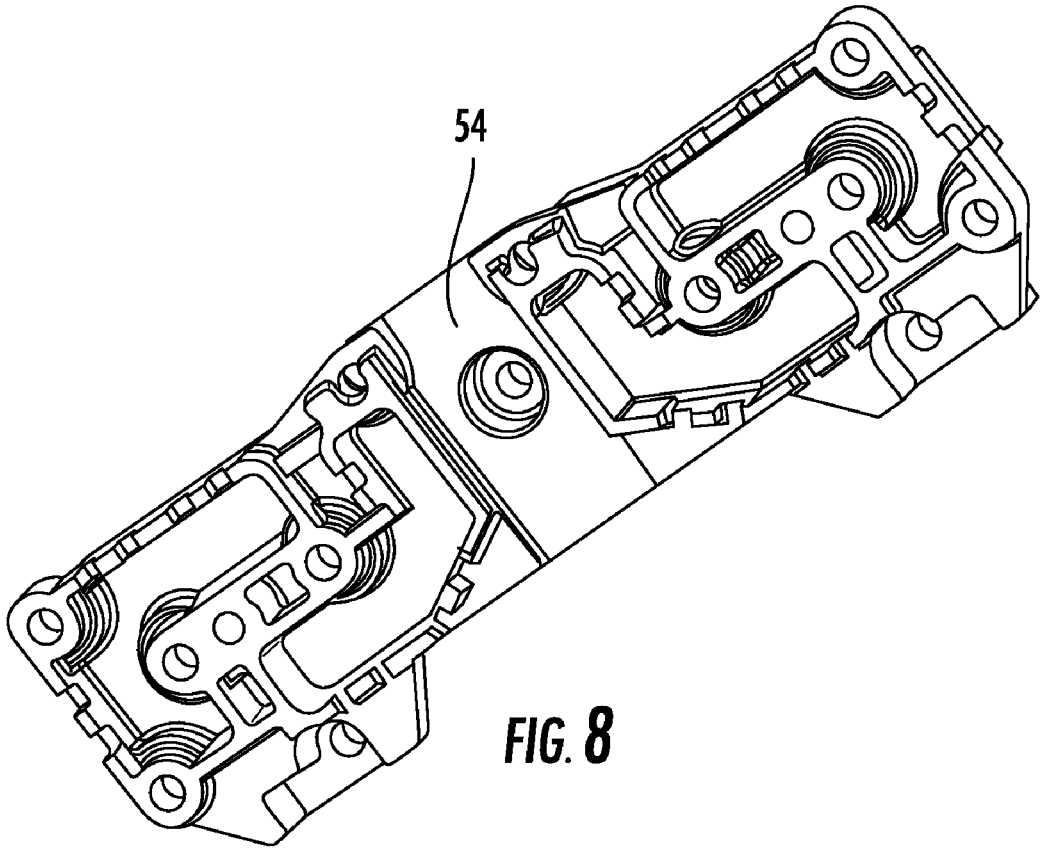
FIG. 8 is a bottom side isometric view of the top shield shown in FIG. 1.

As shown in FIG. 7, to properly terminate the interconnect waveguide(s) 46, a back shield 50 adapted to mount upon the back PCB 38 may be formed with ¼ wavelength waveguide termination cavity(s) 52 in-line with each interconnect waveguide 46. Further cavities and channels may be similarly formed in the back shield 50 to isolate micro strip transmission lines, filters and or surface mount components or the like of the back PCB 38 from each other. As shown in FIG. 8, a similar top shield 54 has cavities for isolating the various LNA circuit(s) 31 and or components of the top PCB 34 from each other. Areas of the main housing 10, back shield 50 and top shield 54 unrelated to interconnections and or shielding may be formed with a supporting structural matrix that reinforces the various components and connections there between but otherwise minimizes the overall volume of required material.

In alternative configurations, not shown in the figures, the input waveguide(s) may be routed directly to the desired PCB, for example to the top PCB 34 via an H-plane waveguide bend formed in the input waveguide(s) 14, 16 or a straight extension of the input waveguide 18 through the back PCB 38. The transition probe(s) 30 may then be formed as trace(s) upon the, for example, top PCB 34 inserted into the input waveguide(s) 14, 16 through probe aperture(s) 32 in the main housing 10 formed as waveguide cross section apertures at the PCB mounting surface 35 which mate with a corresponding aperture formed in the top PCB 34 that the input waveguide(s) 14, 16 pass through. The input waveguide(s) 14, 16 and or 18 may then be terminated by waveguide termination cavities formed in the respective top and or back shield(s), as described with respect to the interconnect waveguide termination cavity(s) 52, above.

Mixer circuit(s) 55 may be added on the back PCB 38 to multi-plex the various signals together, reducing the number of output connector(s) 56 required to couple the feed assembly to downstream signal processing equipment. The mixer circuit(s) 55 may also have further inputs, such as from additional external feeds whose signals are also coupled to the feed assembly, allowing conventional wide angle spaced beams from additional satellites to also be incorporated into a single feed assembly mixer circuit 55 location.

A top cover 57 and a bottom cover 58 environmentally seal the top PCB cavity and the bottom PCB cavity, respectively. The environmental seal may be further enhanced by the addition of sealing gasket(s) 22 adapted to seat between the top cover 57 and or the bottom cover 58 and the main housing 10 in sealing gasket groove(s) 62 formed in the main housing 10. An over cover 60, for example formed from injection molded plastic, may also be used to provide further environmental protection. The over cover 60 also functions as a readily exchangeable surface for ease of OEM brand marking.

The main housing 10, top shield 54 and bottom shield 50 may be cost effectively formed via precision molding techniques such as die casting, One skilled in the art will appreciate that precision molding enables the cost effective formation of the main housing 10 with each of the selected input and inter-cavity waveguides integral and pre-oriented with respect to each other with a repeatable high degree of precision. The various transition probe(s) 30 and power lead(s) 42 of the top PCB 34 and bottom PCB 38 may be precision aligned with their associated by keying the top PCB 34 and bottom PCB 38 to the main housing 10 via one or more keying feature(s) such as pcb alignment dowel post(s) 64 of the main housing 10 that mate to corresponding PCB alignment dowel hole(s) 66 formed in the top and bottom PCBs 34, 38. The integral input waveguide(s) and sub-component alignment resulting from the use of the precision molding main housing significantly reduces the overall number of required components and greatly simplifies assembly and tuning requirements when a feed assembly according to the invention is incorporated into a reflector antenna. Further, the integral transition waveguide(s) 46 coupling the top PCB 34 with the back PCB 38 minimize the number of required solder connections during final assembly.

Table of Parts

| | |
|---|---|
| 10 | main housing |
| 12 | front face |
| 14 | first input waveguide |
| 16 | second input waveguide |

-continued

| Table of Parts | |
|---|---|
| 18 | third input waveguide |
| 20 | radome |
| 22 | sealing gasket |
| 24 | waveguide aperture |
| 26 | forward surface |
| 28 | septum polarizer |
| 30 | transition probe |
| 31 | LNA circuit |
| 32 | probe aperture |
| 34 | top PCB |
| 35 | PCB mounting surface |
| 36 | top PCB cavity |
| 38 | back PCB |
| 40 | back PCB cavity |
| 42 | power lead |
| 44 | power lead aperture |
| 46 | interconnect waveguide |
| 47 | interconnect waveguide bend |
| 48 | interconnect waveguide probe |
| 50 | back shield |
| 52 | waveguide termination cavity |
| 54 | top shield |
| 55 | mixer circuit |
| 56 | output connectors |
| 57 | top cover |
| 58 | bottom cover |
| 60 | over cover |
| 62 | sealing gasket groove |
| 64 | alignment dowel post |
| 66 | PCB alignment dowel hole |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A multi-beam feed assembly housing, comprising:

a plurality of input waveguides disposed in a front face of the housing;

at least two PCB mounting surfaces formed on the housing;

a plurality of probe apertures in the housing coupling the input waveguides and at least one of the PCB mounting surfaces; and at least one interconnect waveguide through the housing between at least two of the PCB mounting surfaces.

2. The housing of claim 1, wherein the housing is adapted for manufacture via die casting.

3. The housing of claim 1, wherein the input waveguides are located in a line and adjacent to each other.

4. The housing of claim 1, wherein the plurality of input waveguides is three input waveguides, and the PCB mounting surfaces are in a top PCB cavity and a back PCB cavity.

5. The housing of claim 1, wherein the at least two PCB mounting surfaces is two PCB mounting surfaces, the two PCB mounting surfaces oriented at a planar angle greater than 30 degrees to each other.

6. The housing of claim 5, wherein the angle is 90 degrees.

7. The housing of claim 1, wherein the front face is adapted to receive a common radome covering each of the plurality of input waveguides.

8. The housing of claim 1, further including at least one key feature disposed in the PCB mounting surface(s) to align a PCB upon the PCB mounting surface(s).

9. A multi-beam feed assembly, comprising:

a feed assembly housing comprising, a plurality of input waveguide(s) disposed in a front face;

at least two PCB mounting surface(s);

a plurality of probe aperture(s) in the housing coupling each of the plurality of input waveguide(s) to at least one of the PCB mounting surface(s); and at least one interconnect waveguide through the housing between at least two of the at least two PCB mounting surface(s);

a plurality of PCBs, each of the plurality of PCBs coupled to a respective one of the at least two PCB mounting surface(s);

a plurality of transition probe(s) located in the probe aperture(s) coupling each input waveguide to a respective one of the plurality of PCBs;

a low noise amplifier on each of the PCB(s) coupled to each of the transition probe(s); and a mixer circuit on one of the plurality of PCBs;

the at least one interconnect waveguide coupling an output of the low noise amplifier(s) on each one of the PCB(s) without the mixer circuit to the PCB with the mixer circuit.

10. The feed assembly of claim 9, further including a polarizer in each input waveguide adapted to separate a circularly polarized input signal into a vertical polarization and a horizontal polarization.

11. The feed assembly of claim 10, wherein there are two transition probes in each of the input waveguides, the transition probes coupling the vertical polarization and the horizontal polarization, respectively, to one of the at least two PCB(s).

12. The feed assembly of claim 9, further including a shield covering at least a portion of at least one PCB.

13. The feed assembly of claim 12, wherein the shield has a waveguide termination cavity for at least one of the interconnect waveguide(s).

14. The feed assembly of claim 9, wherein at least two of the plurality of PCBs are arranged at an angle to each other and the transition waveguide is formed with a transition equal to the angle.

15. The feed assembly of claim 9, wherein the input waveguides are adapted for operation in at least two different frequency bands.

16. The feed assembly of claim 15, wherein the plurality of input waveguides includes a middle input waveguide, a left input waveguide and a right input waveguide; the middle input waveguide adapted to operate in a different frequency band than the left input waveguide and the right input waveguide; the left input waveguide and the right input waveguide arranged on respective right and the left sides of the middle input waveguide.

17. The feed assembly of claim 16, further including a radome covering each of the three input waveguides;

a waveguide aperture of each input waveguide adapted to position the radome at a distance from a forward surface of the input waveguide(s) that is a factor of a desired frequency in the frequency band of each of the input waveguide(s).

18. The feed assembly of claim 9, further including at least one cover adapted to environmentally seal against the housing, enclosing at least one of the PCB(s).

19. The feed assembly of claim 9, further including power leads passing through power lead apertures formed in the housing, the power leads coupling the PCB having the mixer circuit and the PCB(s) without a mixer circuit.

20. A method for manufacturing a multi-beam feed assembly housing, comprising the steps of:

die casting a single body having a plurality of input waveguides formed in a front face, at least two PCB mounting surfaces, a plurality of probe apertures through the housing between the input waveguides and at least one of the PCB mounting surfaces, and at least one transition waveguide through the housing between the PCB mounting surfaces.

* * * * *